US005910034A

United States Patent [19]

Vukelic et al.

[11] Patent Number: 5,910,034

[45] Date of Patent: Jun. 8, 1999

[54] INTEGRAL OVERLAY WAKEBOARD BINDING AND SYSTEM

[75] Inventors: Gregg A. Vukelic, Seattle, Wash.; Eric S. George, Taunton, Mass.

[73] Assignee: Earth & Ocean Sports, Inc., Hyannis, Mass.

[21] Appl. No.: 09/080,069

[22] Filed: May 15, 1998

[51] Int. Cl.[6] ..... B63B 35/86

[52] U.S. Cl. ..... 441/70; 441/68

[58] Field of Search ..... 114/39.2; 440/68, 440/20, 65, 74; 280/607, 617, 618

[56] References Cited

U.S. PATENT DOCUMENTS 5,624,291 4/1997 McClaskey .

FOREIGN PATENT DOCUMENTS 2196905 5/1988 United Kingdom ..... 441/70

*Primary Examiner*—Ed Swinehart
*Attorney, Agent, or Firm*—Richard P. Crowley

[57] ABSTRACT

A wakeboard binding which includes a single piece, adjustable, binding overlay elastomeric sheet material, with a pair of spaced apart extended arms, the binding adapted to be secured over the top surface of a heel and toe receptacle which form a boot-like enclosure.

27 Claims, 10 Drawing Sheets

INTEGRAL OVERLAY WAKEBOARD BINDING AND SYSTEM

BACKGROUND OF THE INVENTION

Wakeboard bindings are foot bindings which are adapted and designed to be employed on a wakeboards, wherein the wakeboard is a recreational sport board, so that the person riding on the wakeboard can be towed behind a boat or jet ski. Wakeboard bindings are generally mounted transversely on a wakeboard, similar to bindings mounted on a snowboard. One wakeboard binding is described in U.S. Pat. No. 5,624,291, issued Apr. 29, 1997.

It is therefore desirable to provide for a new and improved wakeboard bindings and wakeboard system containing the bindings, which wakeboard bindings and system provides certain advantages over the prior art in regard to performance, use, and structure.

SUMMARY OF THE INVENTION

The invention relates to wakeboard bindings and a wakeboard system employing the bindings.

The wakeboard binding of the invention is adapted to be secured to a wakeboard, which binding comprises a bottom support plates typically of aluminum, having a front end, a rear end, a left edge, a right edge, a top surface, and a bottom surface, and characterized by a left row of a plurality of apertures, and a right row of a plurality of apertures. The wakeboard binding includes a cushion foot pad, typically of a molded, flexible foam material of various colors and usually die cut to size. The wakeboard binding includes a heel receptacle having a back surface and a lower edge, with a plurality of apertures generally aligned with the apertures on the support plate, and the heel receptacle extending about the back of the heel of a user. The wakeboard binding also includes a toe receptacle having a top surface and a left and right end, each with a plurality of apertures, and generally aligned with the apertures of the support plate and extending across the top of the foot of a user. The toe and heel receptacle material is usually composed of a rubber sheet material, and more particularly an elastomeric metallocene rubber (EMR) which may be physically bonded to a foam sheet material and die cut to size to provide interior comfort. The EMR and the foam material may vary in density, thickness and color, such as, the foam material having about 22 pounds per cubit foot density and about 0.185 inch thickness and screened with selected graphics. The heel and toe receptacle form a boot-like enclosure on the top surface of the support plate over and about the selected foot pad to receive the foot of the user.

The wakeboard binding includes a binding overlay comprising a single piece of a sheet material having a top, a bottom, and a base section to extend about the surface of the heel receptacle and with an open bottom, heel cup section to extend over and across the heel of a user, and a top left and a top right outwardly elongated, spaced apart, extending arms from the base section, and a bottom left and a bottom right outwardly elongated, spaced apart, extending arms from the base section, and generally, the arms being of a uniform length and parallel to each other. Each arm at the end thereof has a plurality of apertures therein, generally, the apertures are aligned to be adjustably secured to a plurality of apertures in the bottom support plate. The top and bottom arms of the binding overlay are adapted to extend over and across the top surface of the toe receptacle in a crisscross arm relationship. The binding overlay usually comprises a rubber sheet material, and more particularly, a one piece, die cut, EMR sheet material with adjustable holes punched, as desired, for alignment with the apertures in the support plate. The EMR material permits varying selected properties to be employed, such as, varying the density, thickness, or color of the material.

The wakeboard binding also includes a means to clamp respectively, the ends of the extending arms of the binding overlay and the toe and heel receptacle, through the respective apertures, to and into the top surface of the bottom plate by the employment of adjustable, stainless steel machine screws. The support plate typically is formed of an anodized aircraft aluminum, for example, having a thickness of about 0.100 inches. The means to clamp comprises left and right toe bars with holes therein and a molded heel horseshoe-type clamp, through which stainless steel machine screws or bolts may be employed to secure the sides of the toe and heel receptacle and the arms of the binding overlay to the support plate. The wakeboard binding may include an adjustable opening means in the top back of the binding overlay to permit the easier entry of a user's foot into the boot enclosure, such as, the employment of a zipper or an extended pull-on-strap. In addition, the heel and toe receptacle may also include on the top surface thereon, a pair of spaced apart holes aligned on the heel and toe receptacle to aid a user in placing his foot into the boot-like receptacle.

The support plate is characterized by a heel aperture, usually directly positioned beneath the heel of a user, which aperture may, for example, be a rounded trapezoid or other shape aperture and which would include therein a heel cushioning material, such as; but not limited to, a resilient honeycomb air-cell, plastic heel cushion material, die cut to size and of about ¼ inch thickness. The support plate may also be characterized by a substantially circular arc or arcuate, generally open section, centrally located and extending inwardly from the front end of the support plate.

The construction of the wakeboard binding of the invention provides for a plurality of improvements in the structure, performance, and use of the wakeboard binding.

The support plate enables the user to not only rotate each binding to various degrees, but also enables the user to move the plate forward and back over the width of the wakeboard. This allows for users with smaller and larger feet to be centered over the wakeboard.

The keyway system of heel and front apertures allows the manufacturer to use less aluminum material to produce the plate part, thus reducing the weight of the plate. The keyway system also allows the manufacturer to use the same plate for the various sizes. A specialized keyway insert can be put in to handle all types of footbed shapes.

The hardware used comprises a polymer molded, e.g., nylon toe bar and heel horseshoe clamps, optionally, with adjustable overlay bars. The hardware system allows the user to adjust the tension on the binding overlay, with overlay bars, through arm length adjustment, without disassembling the entire heel and toe pieces. In one embodiment, instead of running the overlay under the same hardware that the heel and toe are under, there are separate overlay bars that clamp the overlay between the two pieces of nylon hardware. This system enables the user to rotate the overlay around the radius of the heel horseshoe shape and back and forth along the toe bars. This gives each user the ability to easily modify their bindings to fit their comfort needs. All users usually modify their bindings currently, but it is very difficult because all the material is clamped under the same bars.

The support plate is characterized by a machined hole in the plate directly under the heel of the user. This space allows for a die cut piece of the honeycomb air-cell to be placed in direct contact with the bottom of the footbed pad. This provides the user with a cushion material directly under the heel. The cushion provides a softer landing on air tricks and also absorbs the kinetic energy. Less energy being pushed into the wakeboard will lengthen the board life and comfort the user.

EMR material has been developed to lessen the weight of the binding and enable the binding manufacturer to use various densities thicknesses, and colors. Currently, the industry has used neoprene rubber to produce bindings, so all bindings developed in the industry have the same black look and characteristics. The (EMR) material allows the wake binding quickly to adjust to the changing needs of the market as to color, color combinations, and comfort.

The binding overlay is a single piece of die cut sheet material. The shape of the overlay is a direct function of certain qualities needed to produce a high-end bindings. The heel area is cut out, providing a heel cup or a "pocket" to keep the user's heel locked down in place. The bottom two arms of the overlay are crisscrossed over the top of the toe pieces This provides a user with adjustable support over their toe, minimizing any toe lift. The top two arms of the overlay are also crisscrossed and pulled around to the backsides of the heel horseshoe hardware. The tension and placement of this part of the overlay is also adjustable. These arms are a key part to the overlay binding. Depending on the desired tension by the user, the top arms pull the user's foot and ankle back into the heel "pocket" of the binding. This will minimize the heel lift when performing surface and air tricks. The less heel lift within the binding, the more direct edge control of the wakeboard.

The tight tension created by this binding overlay made it difficult to put on and take off the binding. This lead to the optional, but suggested, addition of the rear entry binding system. The binding can now be put on and taken-off easily and still maintain the tight tension qualities needed in a performance wakeboard binding.

Optionally and preferably, an ankle strap is sewn in place along the top edge of the binding overlay providing the last element needed to prevent any heel lift. This strap, pulled tight around the user as ankle through a D-ring and back around the ankle, sticking onto itself with the VELCRO® (hook and loop fabric), will keep the user's entire foot down in the heel "pocket". The ankle strap allows the high-end rider to be physically restrained into the binding. The foot is able to be pulled out of the binding, but centrifugal force and gravity will not allow the binding to slip during surface or air maneuvers.

In a further embodiment of the invention, which embodiment may be employed generally in wakeboard bindings as a heel receptacle, and particularly with wakeboard bindings having an integral binding overlay as described, the heel receptacle may employ a strap secured thereto to aid in the insertion of a user's foot into the boot-like enclosure.

A sturdy strap, like woven nylon strap, has a top loop extending above the top of the heel receptacle material, e.g., 1 to 3 inches, so that the user may grasp the open loop for assistance in pulling on the wakeboard binding. This loop replaces the use of finger holes presently employed in the art which has been found to sometimes cause ripping of the heel receptacle material.

The strap extends generally centrally down the outside of the heel receptacle and is firmly secured, typically by stitching it to an upper and lower section of the heel receptacle to form an intermediate free loop between the stitched secured section. This arrangement transfers the load or user pulling force to the strap, rather than to the heel material and avoids tearing or ripping of the heel receptacle material in use.

The strap is turned over at the lower end to the lower secured section to form a lower strap loop. This lower loop is for anchoring purposes and is designed so that the heel clamp used generally the horseshoe-shaped heel clamp, passes through the lower loop to anchor the lower end of the strap securely to the heel clamp which is bolted to the support plate.

The extended, multiple loop, secured strap may be used alone to aid insertion of a user foot into the wakeboard binding or in combination with a back closure, such as a zipper, in the wakeboard binding overlay adjacent the back heel enclosure.

The invention shall be described for the purposes of illustration only in connection with certain illustrated embodiments; however, it is recognized that various modifications, additions, improvements, and changes to the illustrated embodiments may be made by those persons skilled in the art without departing from the spirit and scope of the invention as disclosed and claimed.

DESCRIPTION OF THE EMBODIMENTS

Figure 1:
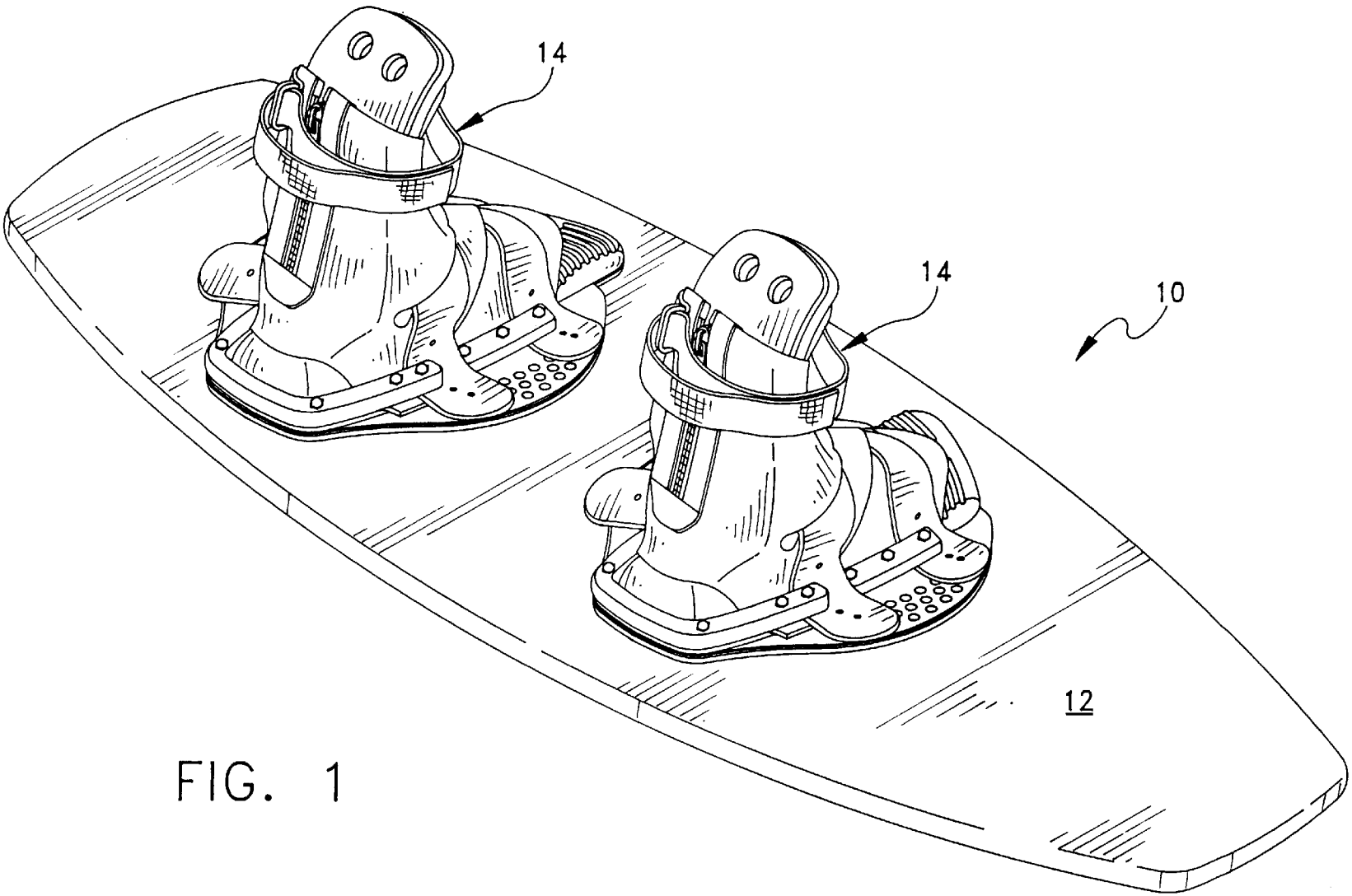
FIG. 1 is a perspective view of a wakeboard with a pair of wakeboard bindings secured thereon.

FIG. 1 is a perspective view of a wakeboard system 10 showing wakeboard 12 and a pair of transversely mounted wakeboard bindings/wakeboard boots 14 mounted on the top surface of the wakeboard.

Figure 2:
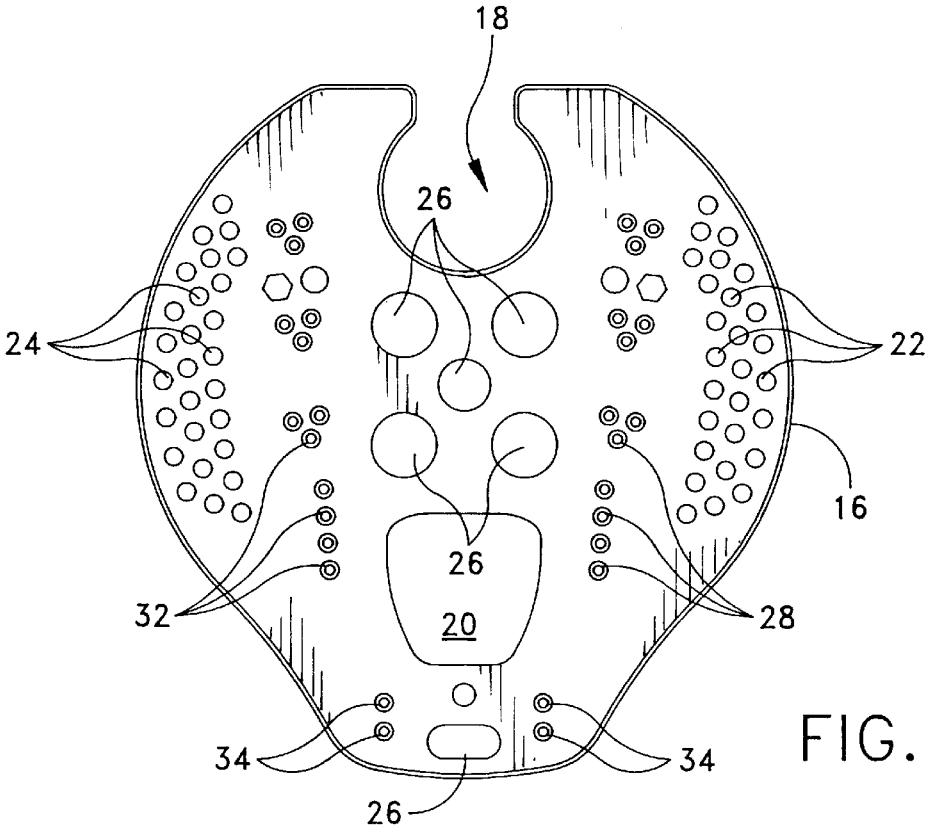
FIG. 2 is a bottom plan view of the support plate of the wakeboard system without the honeycomb cushion material.
Figure 3:
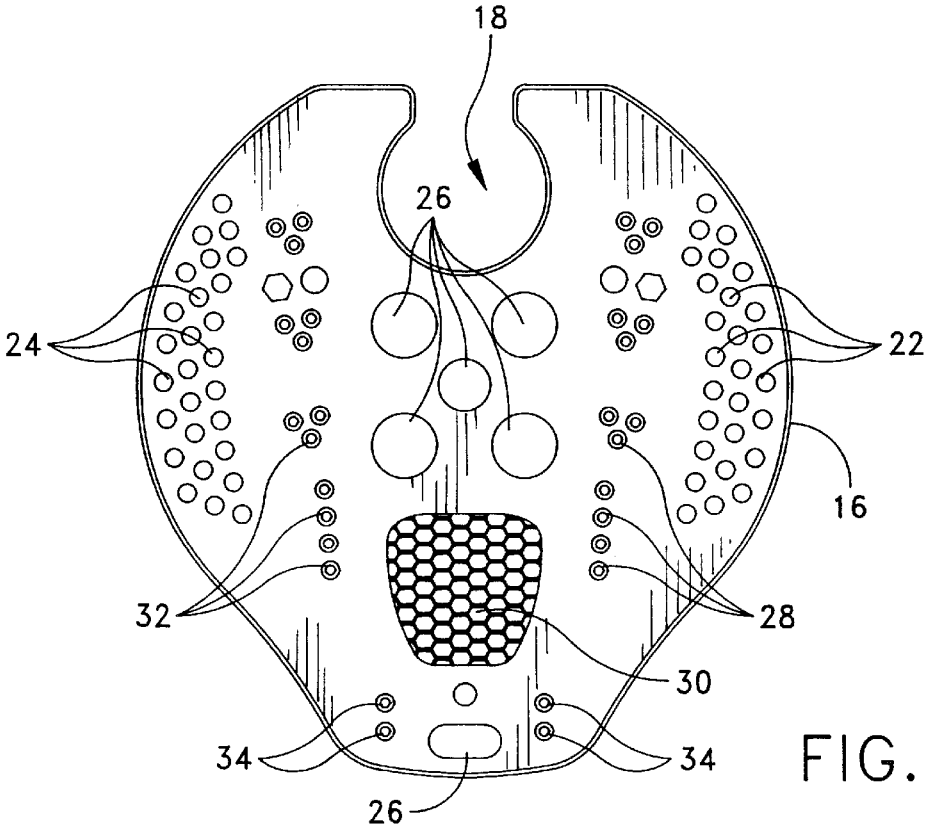
FIG. 3 is a bottom plan view of the support plate of FIG. 1 illustrating the honeycomb cushion material in the heel aperture.

FIGS. 2 and 3 are bottom plan views of the wakeboard binding/boot 14, FIG. 2 illustrating the bottom support plate 16 of the wakeboard binding 14 illustrating a trapezoidal heel cavity 20, while FIG. 3 illustrates the honeycomb (typically hexagonal open cell plastic) cushion material 30 inserted in the heel cavity 20. FIGS. 2 and 3 illustrate the aluminum support plate 16 having a front archward-type, about 270 degree front opening 18 and with a plurality of spaced apart apertures 22 on the right hand side and 24 on the left hand side of the support plate 16. The aluminum support plate 16 also includes a plurality of other holes 26, the primary purpose is merely to reduce the weight of the support plate 16. Also illustrated are bolt heads 28, 32, and 34.

Figure 4:
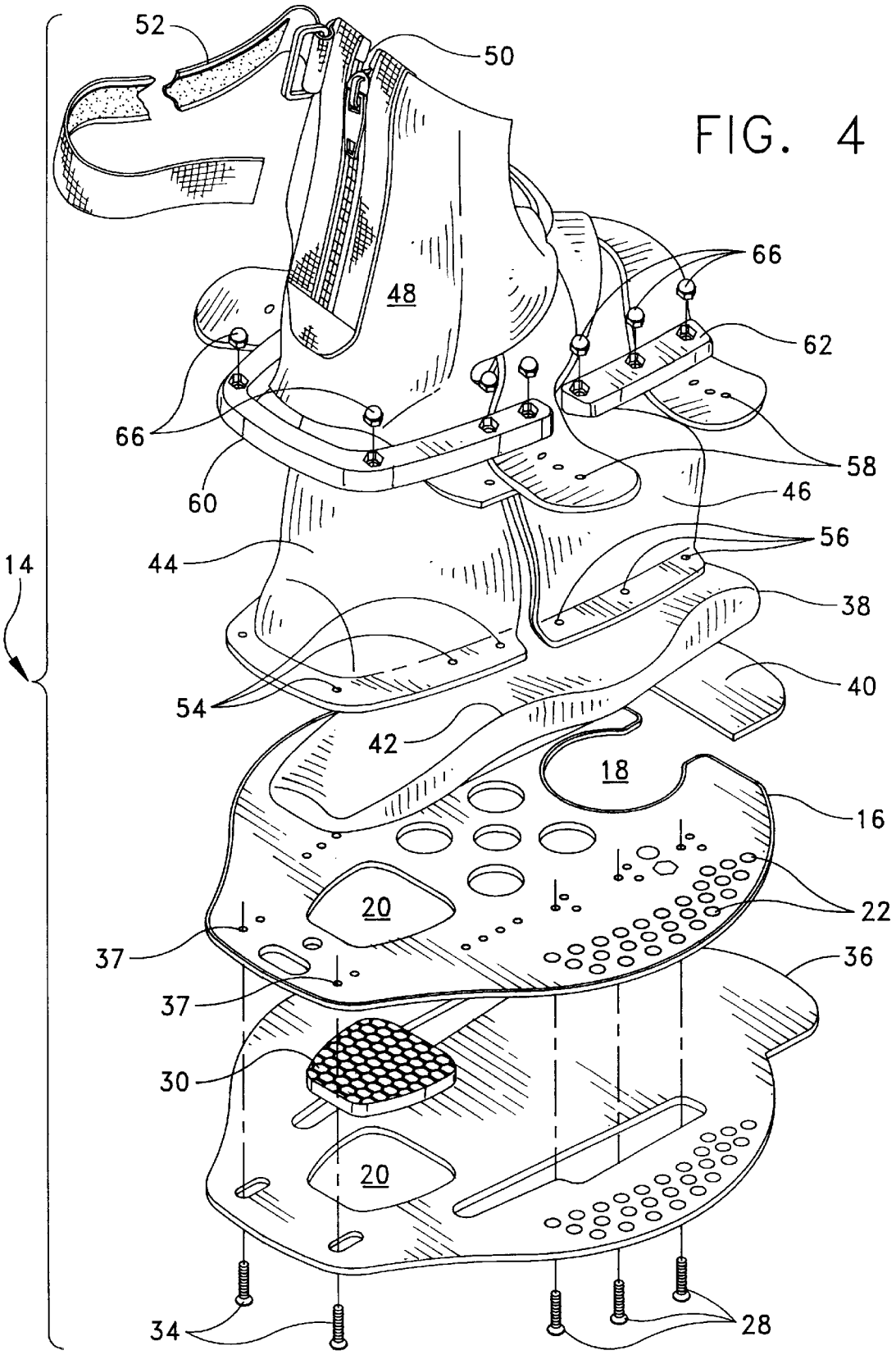
FIG. 4 is an exploded, perspective, back side view of the wakeboard binding.
Figure 5:
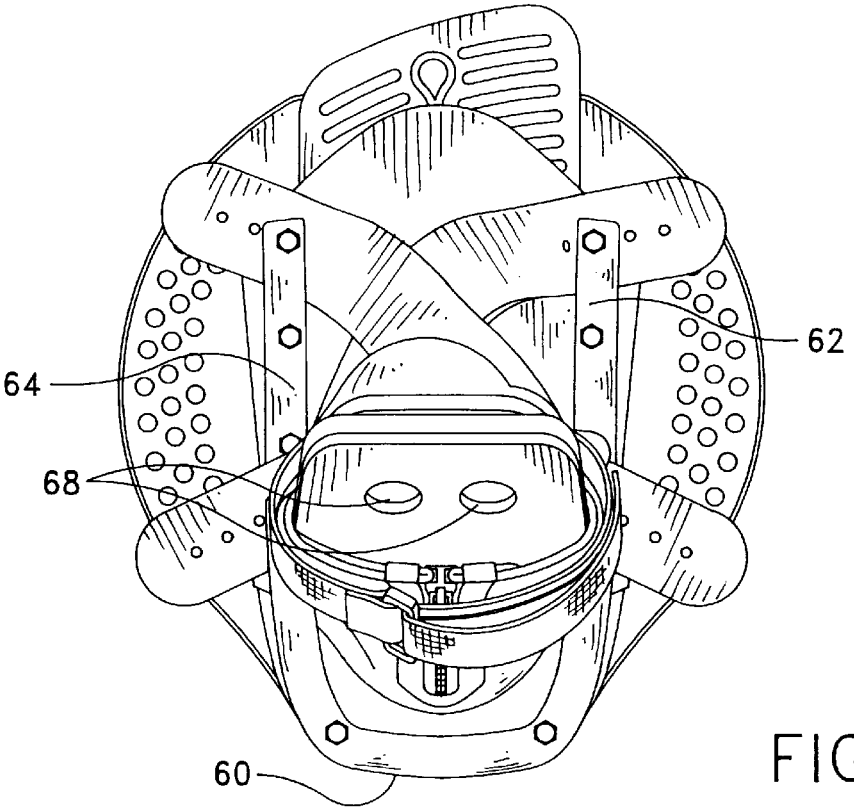
FIG. 5 is a top plan view of the wakeboard binding.
Figure 6:
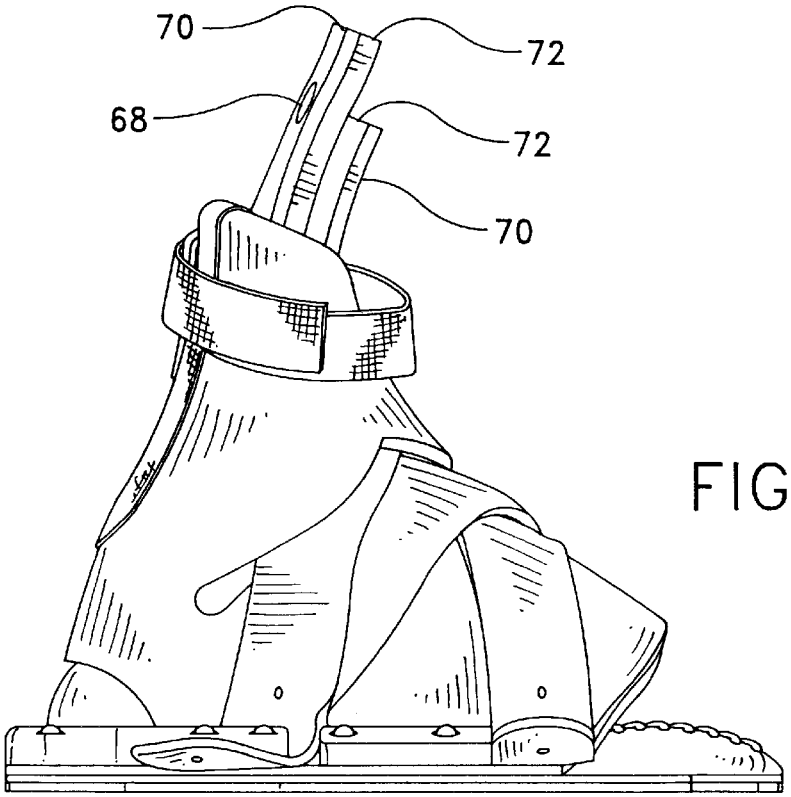
FIG. 6 is side plan view of the wakeboard binding.
Figure 7:
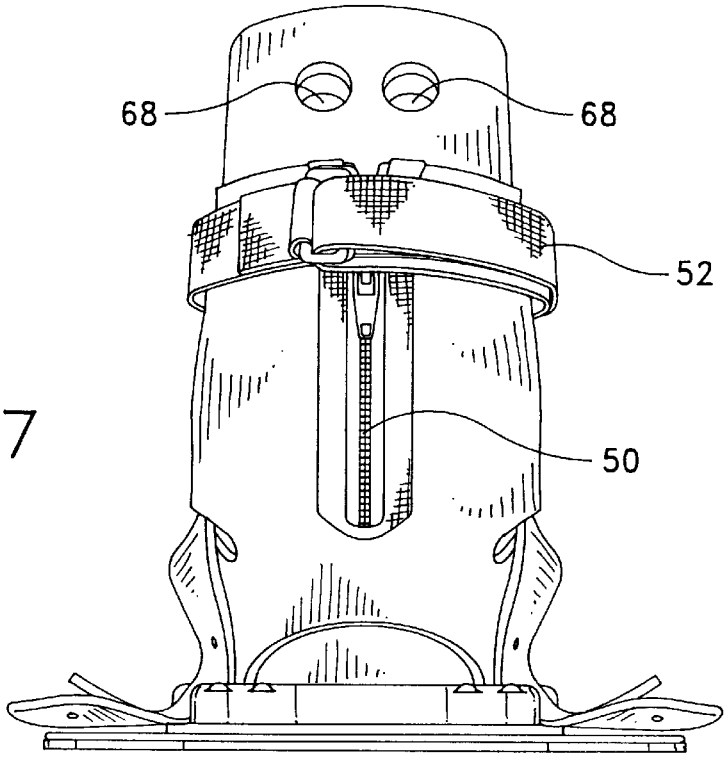
FIG. 7 is a rear plan view of the wakeboard binding.
Figure 8:
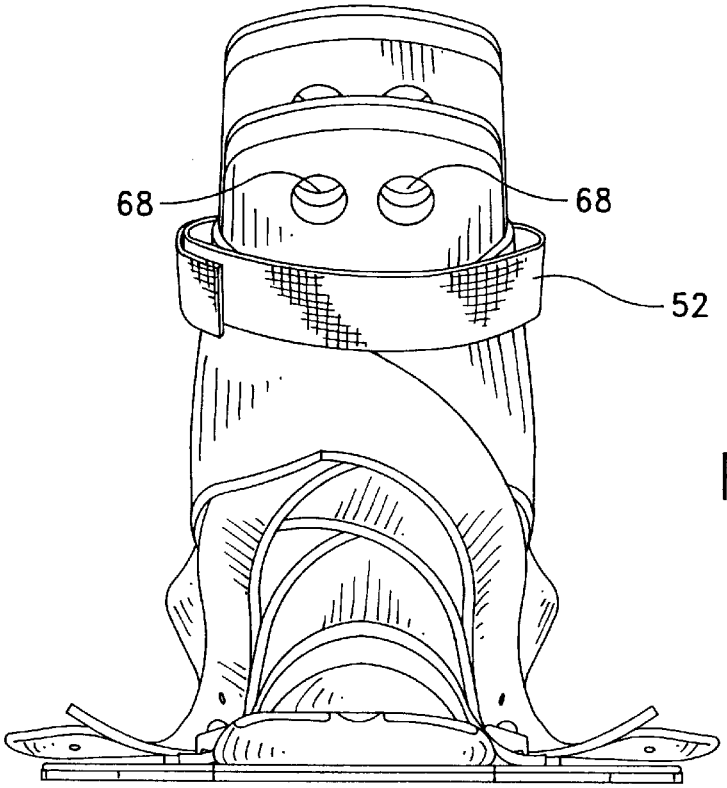
FIG. 8 is a front plan view of the wakeboard binding.
Figure 9:
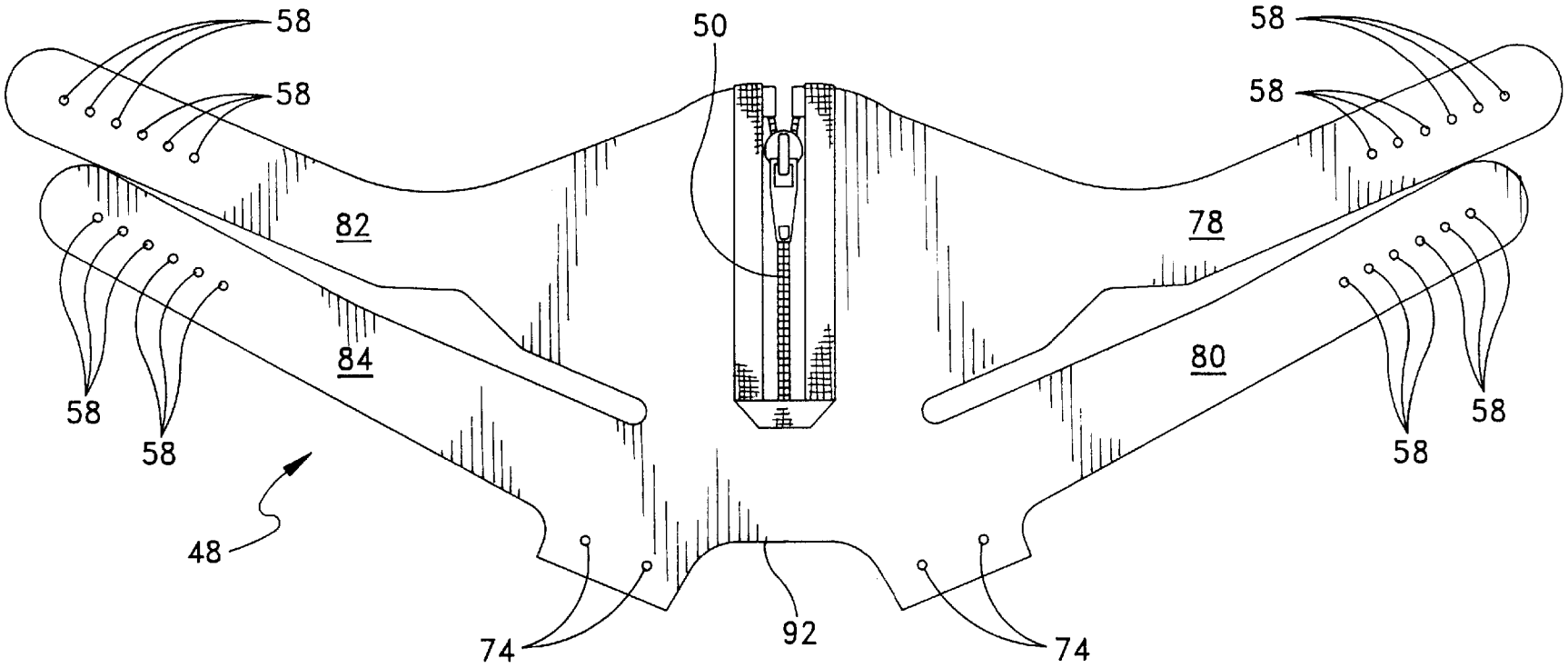
FIG. 9 is a back plan view of the binding overlay used on the wakeboard binding.

FIG. 4 is an exploded perspective view from the back side of the wakeboard binding 14 of the invention showing a bottom foam or rubber layer 36 which is secured to the bottom surface of the aluminum support plate 16 and a foam foot pad 38 having an arch 42 and typically formed of 4 to 6 pounds of EVA foam and with an extended support toe piece 40 also of EVA foam. A heel receptacle is illustrated in heel sheet receptacle material element ii and a toe sheet material receptacle element 46, a while i s represents a single piece, die cut, binding overlay 48 (see FIG. 9). The binding overlay 48 includes a rear zipper 50 for ease of entry and comprises a one piece, die cut, EMR material with adjustable holes 58 and each extending arm 78, 80, 82, and 84 and rear heel holes 74 and open heel receptacle 92. The wakeboard binding 14 also has an ankle strap 52 and with the heel receptacle 44 and the toe receptacle 46 having the respective holes on the flanges 54 and 56 which are to be aligned with the respective holes 37 in the support plate 16. The binding 14 also includes a nylon molded toe bar 62 and 64 and a nylon molded horseshoe-type heel clamp 60 and with respective bolt nut 66 and holes in the heel 68 and the heel element 44 and the binding overlay 48.

The binding overlay 48 comprises a one piece, die cut rubbers typically of EMR materials with the adjustable holes 58 punched in each of the peripheral ends of the arms 78, 80, 82, and 84, with tension adjustment of the arms in place. The heel element 44 and toe element 46 are composed of elastomeric metal seam rubber, EMR material, 70 and the material physically bonded to an interior foam-type material 72, for example, having a EVA foam density of about 18 to 24 pounds per cubit foot and with the EMR layer 70 layer being of a different colors for example, yellow or red to contrast with the gray or black foam layer 72.

Figure 10:
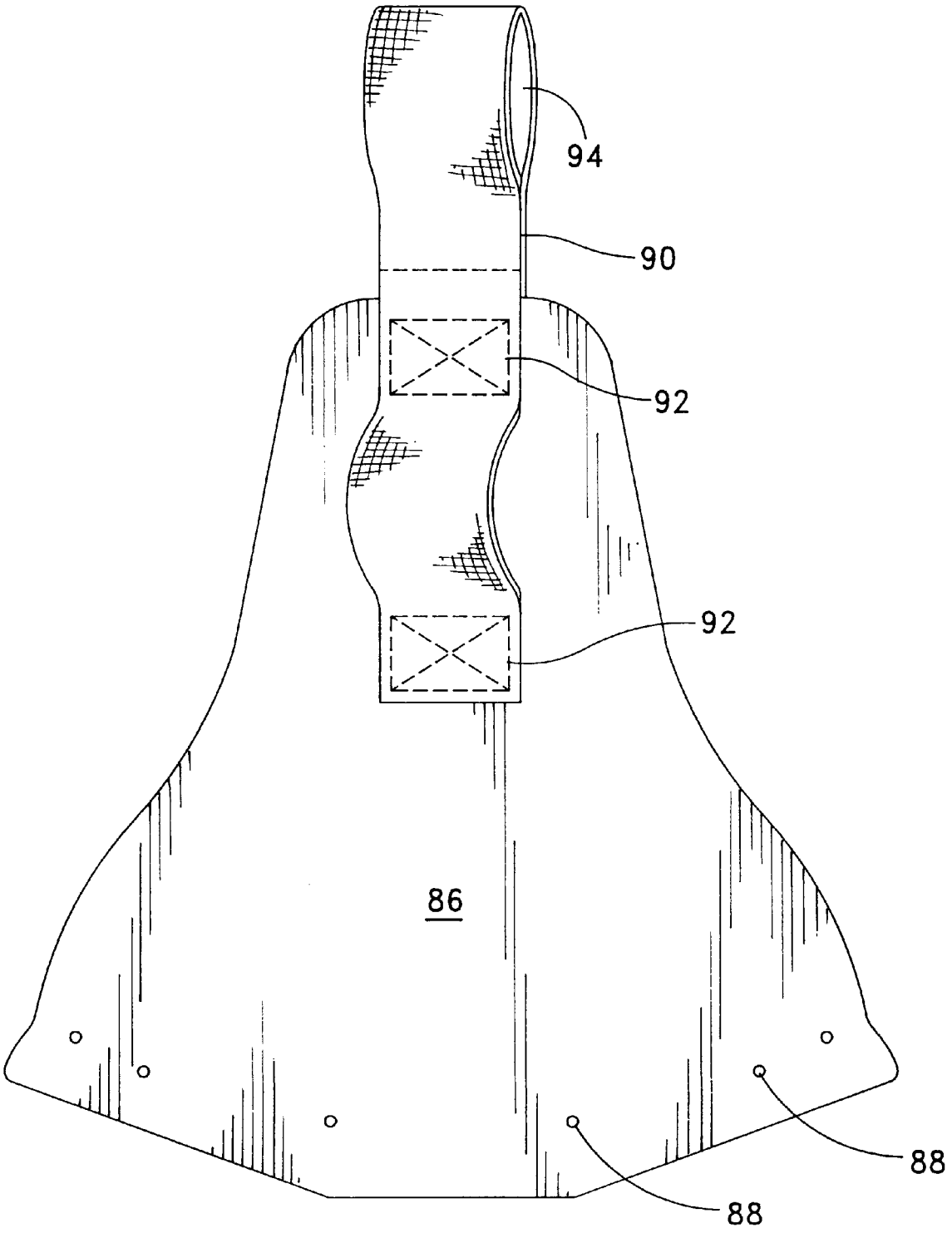
FIG. 10 is a back plan view of a heel receptacle used on the wakeboard binding.

FIG. 10 is a modified heel element 86, modified from heel element 44 having rear holes 88 for securing to the aluminum support plate 16 and having a pull-on, web-type open strap 90 with open loop for pulling 94 to aid in the entry of a user's foot. The web-type strap 90 secured by cross-stitches 92 to the heel element 86. Both the heel receptacle element 44 and the toe receptacle element 46 include an extended-type tongue with two spaced apart holes 68 going through the bonded EMR foam material 70 and 72, generally aligned for use by a user.

Figure 11:
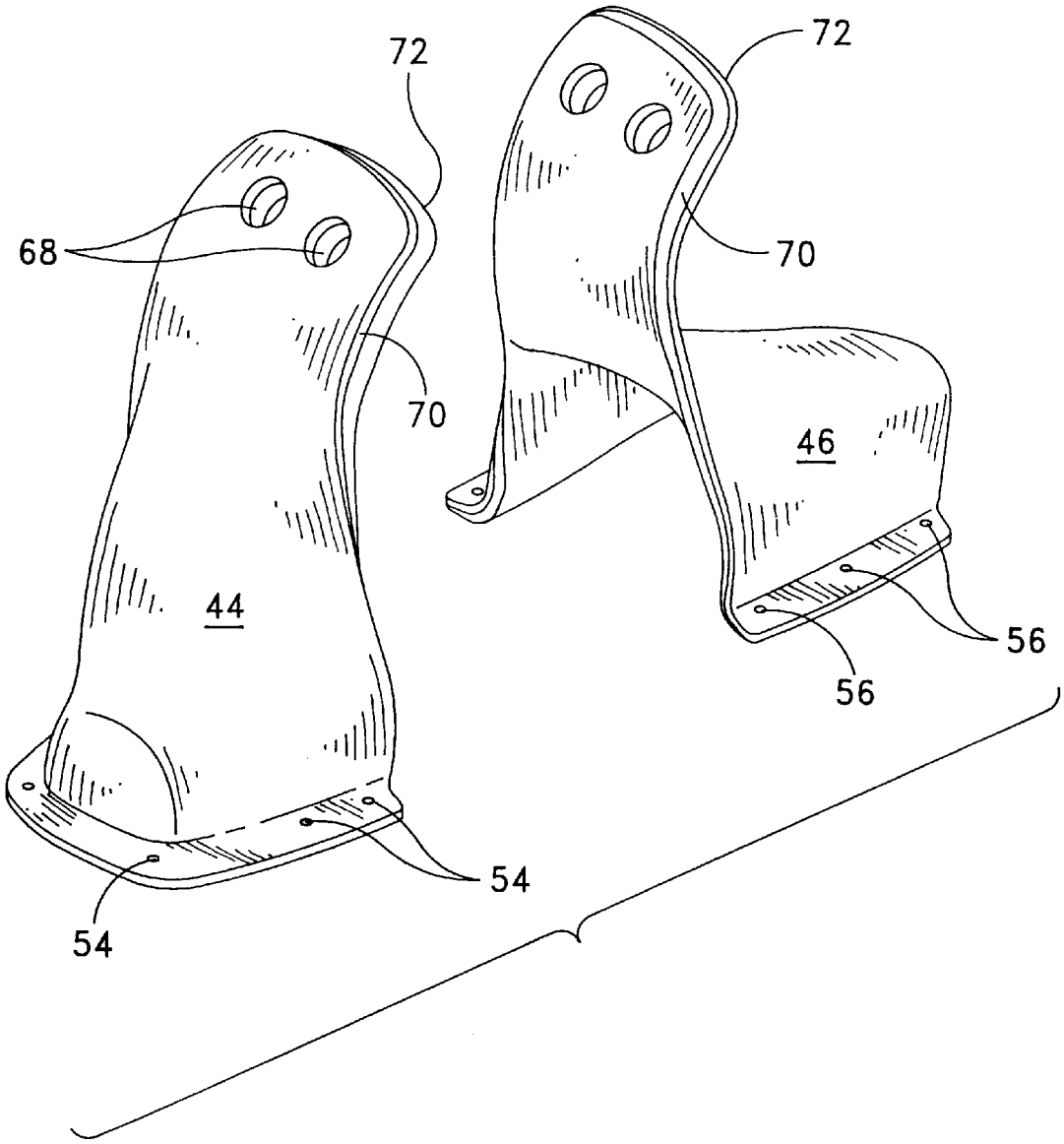
FIG. 11 is a partially exploded perspective view from the side rear of the heel and toe receptacle in the wakeboard binding.

FIG. 11 is an exploded perspective view of the heel and toe elements broken away from the wakeboard binding 14 to illustrate these elements, more particularly, prior to attachment to the aluminum support plate 16 to show these elements in combination form a boot-like receptacle for the foot of a user.

Figure 12:
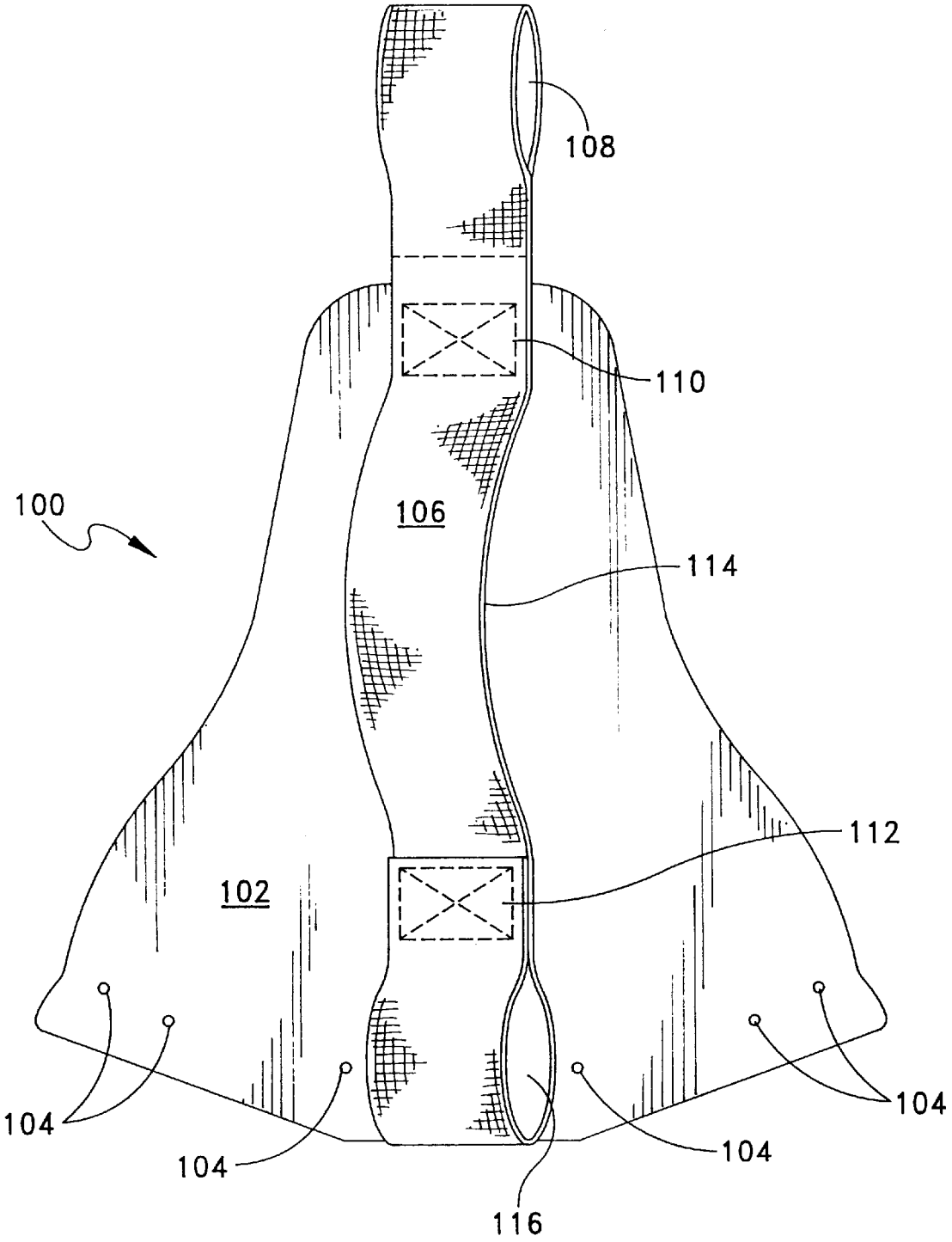
FIG. 12 is a back plan view of a modified strap heel receptacle for a wakeboard binding.

FIG. 12 is a back plan view of a modified strap heel receptacle 100 to form a boot-like enclosure on a wakeboard binding 14. The heel receptacle material 102 comprises a sheet material, typically an elastomeric material like EMR alone or with an inner bonded layer of a flexible foam material. The receptacle includes a plurality of holes 104 to secure the bottom portion of the receptacle by fasteners, like screws or bolts, to a support plate. The receptacle 100 includes a web-type strap 106 extending generally centrally from the top to the bottom of the heel receptacle 100 and forming an upper, user pull on loop 108, an intermediate loop 114, and an anchoring loop 116 through which a horseshoe-type heel clamp bar or other clamp bar is inserted for bolting-screwing to the support plate. The loops 108, 114, and 116 are formed in the single piece of strap material 106 by securely cross-stitching (dotted lines) upper and lower sections 110 and 112 to the heel receptacle material 102. The extended, multiple loop strap 106 permits the user to pull on the binding without damage to the heel material 102.

Figure 13:
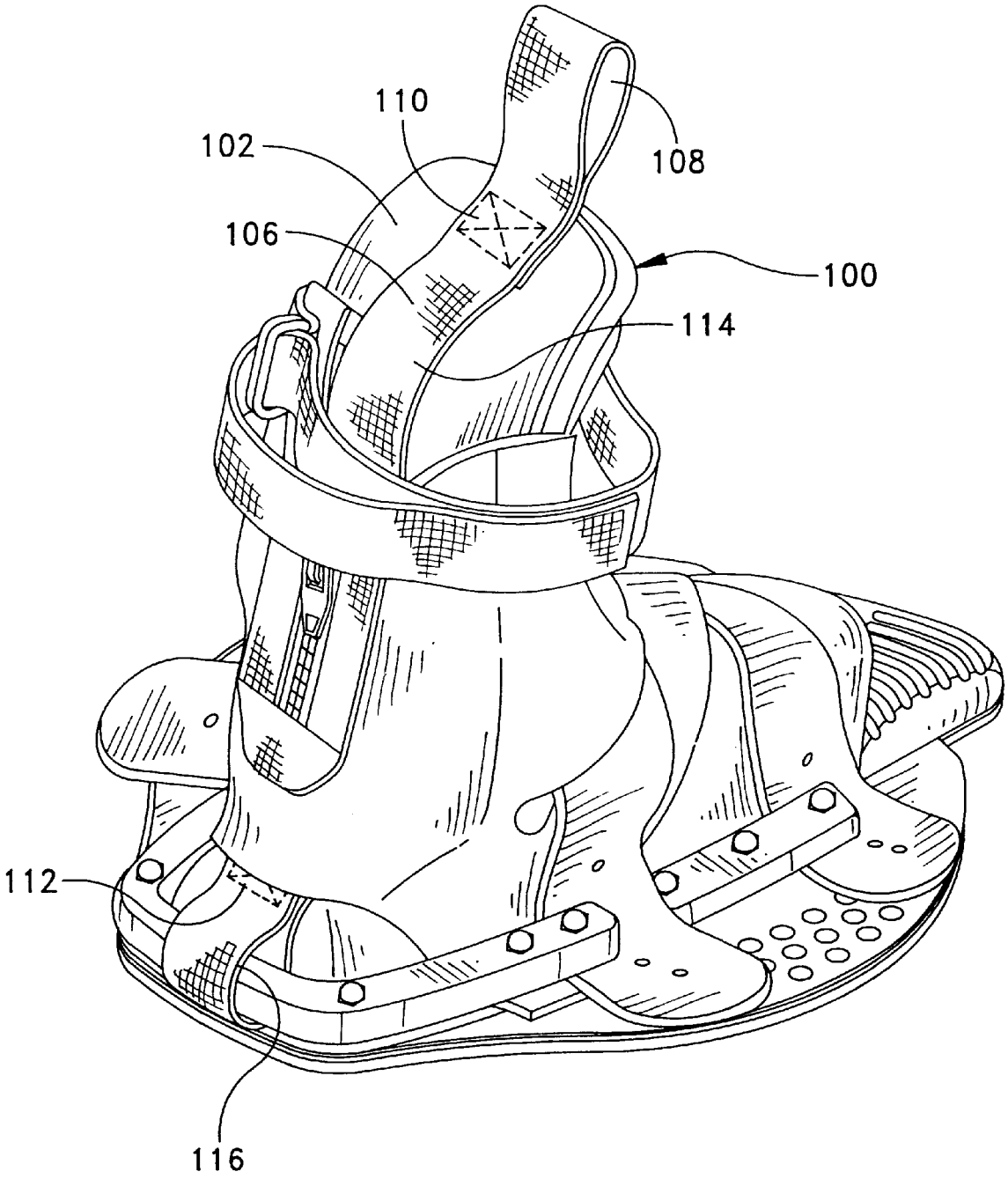
FIG. 13 is a perspective view from above of the strap heel receptacle of FIG. 12 in a wakeboard binding.

FIG. 13 is a perspective plan view from above of a wakeboard binding 14 illustrating the use of the strap heel receptacle 100 in use with the binding 14 and showing the horseshoe-type heel clamp 60 bolted the lower loop 116, and the clamp 60 bolted to the support plate 16, with the horseshoe-type heel clamp 60 extended through the lower loop 116 of the web-type strap 106 to anchor securely the lower strap end.

As it is illustrated in the drawings, the one piece, die cut, binding overlay permits rapid and effective adjustment of the desired tension by crisscrossing the respective upper arms 78 and 82 and the lower arms 80 and 84 across the top surface of the respective heel and toe elements 44 and 46. This arrangement permits clamping of the respective arms 78, 80, 32, and 84 to the desired tension through the holes 58 at the end of each arm, with the open end 92 and rear 74 secured to the aluminum support plate 16. While the zipper 50 permits easy entry into the rear of the boot receptacle.

As set forth, the binding overlay 48; together with the material, construction and adjustment, alone and in combination with the other features of the wakeboard binding 14 as described and disclosed, provides many advantages and improvements over prior art wakeboard bindings.

What is claimed is:

1. A wake board binding adapted to be secured to a wake board which binding comprises:

a) a bottom support plate having a front end, a rear end, a left edge, a right edge, a top surface, and a bottom surface, and characterized by a left row of a plurality of apertures and a right row of a plurality of apertures;

b) a cushioned foot pad secured to the top surface of the support plate;

c) a heel receptacle having a back surface and lower edge with a plurality of apertures and extending about the back of the heel;

d) a toe receptacle having a top surface and left and right ends, each with a plurality of apertures and extending across the foot of a user;

e) the heel receptacle and the toe receptacle forming an enclosure on the top surface of the support plate and about the foot pad to receive a foot of the user;

f) a binding overlay comprising a single piece of sheet material having a top and a bottom and a base section to extend about the back surface of the heel receptacle, with an open bottom heel cup section to extend over and across the heel of the user, and a top left and a top right outwardly extending arm from the base section, and a spaced apart bottom left and a bottom right outwardly extending arm from the base section, each arm at the end thereof having a plurality of apertures therein to secure adjustably the arms; the top and bottom arms extending across and over the top surface of the toe and heel receptacle in a crisscross relationship; and g) means to clamp respectively the ends of the extending arms and toe receptacle and heel receptacle through the respective apertures to the top surface of the bottom plate to provide selected support and tension to the overlay binding.

2. The binding of claim 1 which includes an adjustable opening means in the top back of the binding overlay to permit the entry of a user's foot into the enclosure.

3. The binding of claim 1 wherein the opening means comprises a zipper.

4. The binding of claim 1 wherein the support plate is characterized by a heel aperture beneath the heel of a user and which aperture includes therein a heel cushioning material therein.

5. The binding of claim 4 wherein the heel cushioning material comprises a plastic open core honeycomb material.

6. The binding of claim 1 wherein the binding overlay comprises a surface piece of die cut rubber material.

7. The binding of claim 6 wherein the heel receptacle and the toe receptacle comprises an elastomeric metallocene rubber material.

8. The binding of claim 7 wherein the elastomeric metallocene rubber material comprises an EMR material bonded to an interior flexible foam sheet material.

9. The binding of claim 1 wherein the binding overlay comprises an elastomeric metallocene rubber material.

10. The binding of claim 1 wherein the clamping means includes adjustable screws with a left toe bar, a right toe bar, and a horseshoe heel clamp bar.

11. The binding of claim 1 wherein the foot pad comprises a foam cushioned arch foot pad.

12. The binding of claim 1 which includes an adjustable extending strap secured at one end to the top of the base section and adapted to be adjustably secured about the ankle of a user.

13. The binding of claim 1 wherein the support plate is characterized by a substantially circular, generally centrally located aperture, extending inwardly from the front end of the support plate.

14. The binding of claim 1 wherein the support plate is generally circular and includes a foam layer on the bottom surface.

15. The binding of claim 1 which includes a pull-on strap having a one end and the other end and secured at one end to a top of the heel receptacle to aid in inserting a user's foot.

16. The binding of claim 1 wherein the heel receptacle comprises a sheet material having a top and bottom and which includes an elongated strip extending generally centrally from the top to the bottom, which strip is secured at an upper and lower section to an exterior surface of the sheet material and forms a pull-on strap upper loop extending from the top of the sheet material, an intermediate loop to transfer the pull-on load and a lower loop to be anchored by a hell clamp means to the support plate.

17. The binding of claim 16 which includes a horseshoe-shaped heel clamp as the heel clamp means to clamp; the heel clamp extending through the lower strap loop and fastened to the support plate.

18. A wake board system which comprises a wakeboard having a top surface, and which includes secured to the wakeboard top surface, a pair of wakeboard bindings of claim 1.

19. A wake board binding which comprises:

a) a bottom support plate;

b) a heel and toe receptacle having a back heel section and a toe section forming an enclosure secured to the support plate for the foot of a user;

c) a foot pad secured to the support plate and within the heel and toe receptacle;

d) an integral, one piece binding overlay comprising a rubber material having a top and a bottom and a base section which extends about a back section of the heel and toe receptacle and having an open U-shaped, bottom heel cup section to extend across the heel of the user and spaced apart, generally parallel, top left and top right and bottom left and bottom right extending arms of generally about equal length, the extending arms arranged in a crisscross relationship over the toe section; and e) a threadably adjustable clamp means to retain the ends of the extending arms and the heel and toe receptacle to the support plate.

20. The binding of claim 19 which includes a cut out heel opening, directly below the heel of the user in the bottom support plate, and an open honeycomb, plastic cushion sheet material within the secured heel section.

21. The binding of claim 19 wherein the rubber material of the binding overlay comprises an elastomeric metallocene rubber material.

22. The binding of claim 19 which includes an adjustable ankle strap having a one end and other end, with one end secured to the top of the base section of the binding overlay.

23. The binding of claim 19 wherein the base section of the binding overlay includes a generally centrally positioned zipper extending downwardly from the top of the base section for ease of entry of the user's foot into the enclosure.

24. The binding of claim 19 wherein the support plate is characterized by about a 270 degree arcuate opening extending inwardly from the front end of the support plate.

25. A wakeboard system which comprises a wakeboard for use on water and having a top surface and a pair of spaced apart positioned wakeboard bindings of claim 20 secured to the top surface thereof.

26. A wakeboard binding adapted to be secured to a wakeboard, and which binding includes a binding overlay comprising a single piece of sheet material having a top and a bottom and a base section to extend about the back surface of a heel receptacle, with an open bottom heel cup section to extend over and across the heel of the user, and a top left and a top right outwardly extending arm from the base section, and a spaced apart bottom left and a bottom right outwardly extending arm from the base section, each arm at the end thereof having a plurality of apertures therein to secure adjustably the arms, the top and bottom arms extending across and over a top surface of a toe receptacle and said heel receptacle in a crisscross relationship.

27. A wakeboard binding adapted to be secured to a wakeboard, which binding comprises a sheet heel receptacle material having a top, a bottom, and an exterior surface; and a sheet toe receptacle material, which together, in combination, form an enclosure to receive the foot of a user, and a support plate to which the enclosure is fastened, and which includes a binding overlay means with extending arms to be secured in a crisscross relationship about a top surface of the toe receptacle; the heel receptacle having an extended strap secured to the exterior surface, at an upper and lower section, to form an upper and extended open strap loop, as a pull-on loop for a user from the top of the heel receptacle, and an intermediate strap loop to transfer the pull-on load and to prevent damage to the heel receptacle material in use, and a lower strap loop, and a bar heel clamp means through the lower strap loop which is secured to the support plate to anchor the extended strap.

* * * * *

UNITED STATES PATENT AND TRADEMARK OFFICE

CERTIFICATE OF CORRECTION

PATENT NO. : 5,910,034

DATED : June 8, 1999

INVENTOR(S) : Gregg A. Vukelic, et. al.

It is certified that error appears in the above-indentified patent and that said Letters Patent is hereby corrected as shown below:

Column 8, line 34, claim 25. Delete "20" and insert--19--

Signed and Sealed this

Sixteenth Day of November, 1999

*Attest:*

*Attesting Officer*

Q. TODD DICKINSON

*Acting Commissioner of Patents and Trademarks*